United States Patent [19]

Tsujino et al.

[11] 4,245,037

[45] Jan. 13, 1981

[54] DIRECT POSITIVE SILVER HALIDE LIGHT-SENSITIVE MATERIAL

[75] Inventors: Nobuyuki Tsujino; Shigeo Hirano; Keiichi Adachi, all of Minami-ashigara, Japan

[73] Assignee: Fuji Photo Film Co., Ltd., Minami-ashigara, Japan

[21] Appl. No.: 88,232

[22] Filed: Oct. 25, 1979

[30] Foreign Application Priority Data

Nov. 30, 1978 [JP] Japan ..... 53-148522

[51] Int. Cl.[3] ..... G03C 1/36

[52] U.S. Cl. ..... 430/559; 430/598; 430/570; 430/580; 430/581; 430/591; 430/592; 430/589; 430/211; 430/410; 430/217; 564/27

[58] Field of Search ..... 430/598, 410, 559, 570, 430/580, 581, 591, 592, 589, 211, 217; 260/552 R

[56] References Cited

U.S. PATENT DOCUMENTS

| | | | |
|---|---|---|---|
| 3,227,550 | 1/1966 | Whitmore et al. | 430/559 |
| 4,030,925 | 6/1977 | Leone et al. | 430/598 |
| 4,080,207 | 3/1978 | Leone et al. | 430/217 |

*Primary Examiner*—Won H. Louie, Jr.

*Attorney, Agent, or Firm*—Sughrue, Rothwell, Mion, Zinn and Macpeak

[57] ABSTRACT

A direct positive light-sensitive silver halide photographic material comprising a support having thereon a layer containing a compound represented by the formula (I):

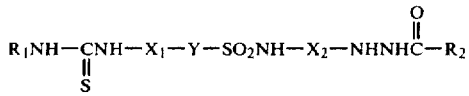

(I)

wherein $R_1$ represents an aliphatic residue or an aromatic residue; $R_2$ represents a hydrogen atom, an aliphatic residue, or an aromatic residue; $X_1$ and $X_2$, which may be the same or different, each represents a divalent aromatic residue; and Y represents

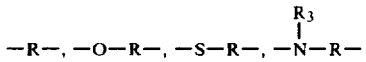

or a direct bond wherein the O or S is bonded to $X_1$; R represents a divalent aliphatic residue and $R_3$ represents an aliphatic residue or an aromatic residue. The compound is particularly effective in combination with a diffusible dye releasing dye image providing compound having an o-hydroxyarylsulfamoyl group.

16 Claims, No Drawings

DIRECT POSITIVE SILVER HALIDE LIGHT-SENSITIVE MATERIAL

BACKGROUND OF THE INVENTION

1. Field of the Invention

The present invention relates to a silver halide photographic light-sensitive material by which direct positive photographic images are formed and, more particularly, to a photographic light-sensitive material, whose photographic emulsion layers or other hydrophilic colloid layers contain a novel compound as a fogging agent.

2. Description of the Prior Art

In the field of silver halide photography, a technique in which positive photographic images are obtained without going through negative images or intermediate processing producing negative images is called direct positive photography, and photographic light-sensitive materials and photographic emulsions using such a photographic technique are called direct positive light-sensitive materials and direct positive photographic emulsions, respectively.

A variety of direct positive photographic techniques are known. The most useful methods are methods in which silver halide grains which have previously been fogged are exposed to light in the presence of a desensitizer followed by development, and methods comprising exposing a silver halide emulsion containing silver halide grains having light-sensitive specks mainly inside the silver halide grains to light and then developing the exposed emulsion in the presence of a fogging agent. The present invention relates to the latter technique. Silver halide emulsions possessing light-sensitive specks in the inside of the silver halide grains and forming latent images mainly inside the grains are referred to as internal latent image type silver halide grains and thus distinguished from silver halide grains which form latent images mainly on the surface of the grains.

A method for obtaining direct positive images by surface-developing an internal latent image type silver halide photographic emulsions in the presence of a fogging agent, and photographic emulsions and photographic light-sensitive materials employed for such a method are disclosed in U.S. Pat. Nos. 2,456,953, 2,497,875, 2,497,876, 2,588,982, 2,592,250, 2,675,318 and 3,227,552, and British Pat. Nos. 1,011,062 and 1,151,363, Japanese Patent Publication No. 29405/68, etc.

In the internal latent image type method for obtaining direct positive images, the fogging agent can be incorporated into a developing solution, however, by incorporating the fogging agent into photographic emulsion layers or associated layers of the light-sensitive material and thereby adsorbing it onto the surface of the silver halide grains, better reversal characteristics can be obtained.

As fogging agents which are employed in the above-described method for obtaining direct positive images, there are hydrazine and derivatives thereof as described in U.S. Pat. Nos. 2,563,785, 2,588,982 and 3,227,552, respectively. In particular, U.S. Pat. No. 3,227,552 discloses that hydrazide and hydrazine type compounds which are derivatives of hydrazine can be incorporated not only in developing solution but also in light-sensitive layers.

However, when hydrazine compounds are incorporated into the emulsion layer, the compounds must be employed in a considerably high concentration (e.g., about 2 g per mol of silver), and in addition, because the fogging agent is transferred from the emulsion layer to the developing solution during development processing, the concentration of the fogging agent in the emulsion varies and unevenness in the maximum density results (at the non-exposed areas), i.e., the fogging effect becomes non-uniform, in the case of multilayer color light-sensitive material, among the emulsion layers.

Furthermore, it is known that these fogging agents evolve nitrogen gas during fogging. This gas gathers in a film to form gas bubbles, which sometimes imparts unexpected damage to photographic images.

In order to avoid these shortcomings, fogging agents comprising heterocyclic quaternary salt compounds described in U.S. Pat. Nos. 3,615,615, 3,719,494, 3,734,738 and 3,759,901, Japanese Patent Application (OPI) Nos. 3426/77 (The term "OPI" as used herein refers to a "published unexamined Japanese patent application") and 69613/77 have been used.

However, in most cases, sensitizing dyes are incorporated into the silver halide emulsion for spectral sensitization, and particularly in color light-sensitive materials, layers which are respectively sensitive to both green light and red light in addition to a layer sensitive to blue light are essentially required and emulsions in the green sensitive layer and red sensitive layer necessarily contain sensitizing dyes. In direct positive emulsions, where fogging agents are contained together with sensitizing dyes sensitive to green light and red light, competitive adsorption in the silver halide emulsion occurs between the sensitizing dyes and the quaternary salt fogging agent. If a fogging agent in an amount sufficient to form the fogging centers is incorporated into the emulsion, spectral sensitization is prevented. On the other hand, if a sprctrally sensitizing dye in a concentration sufficient to obtain desired spectral sensitization is incorporated into the emulsion, the formation of the fogging center is prevented.

One means for overcoming this disadvantage, wherein a sensitizing dye having a nucleating substituent in the dye molecule is employed, is disclosed in U.S. Pat. No. 3,718,470.

However, when nucleating activity as well as spectrally sensitizing activity are simultaneously imparted to one molecule, the use of the dye in an appropriate amount for the spectral sensitization is insufficient for the nucleating activity, and on the other hand, the use of the dye in an amount sufficient for the nucleating activity is inappropriate for the spectral sensitization.

In addition, a disadvantage which is common to the hydrazine type compounds and heterocyclic quaternary salt compounds is their large temperature-dependency for the nucleating activity. That is, if the developing temperature is low, the lower is the nucleating activity, and if the developing temperature is high, the sensitivity is reduced.

In order to eliminate this disadvantage, it has been proposed in U.S. Pat. No. 4,030,925 (corresponding to German Patent Application (OLS) No. 2,635,316) and U.S. Pat. No. 4,031,127 (corresponding to German Patent Application (OLS) No. 2,635,317) that acyl hydrazinophenylthiourea compounds be employed.

The compounds described in the above-mentioned U.S. patents are substantially insoluble in water and have an extremely low solubility in organic solvents. Thus, in order to incorporate the compounds into a hydrophilic colloid layer such as a light-sensitive layer, therefore, the compound is dissolved in a large amount of organic solvent and the solution is added to a solution of a hydrophilic colloid. However, when a large amount of organic solvent is added to a solution of a hydrophilic colloid, the deposition or aggregation of the hydrophilic colloid such (as in the case of gelatin) tends to occur, and, when such a solution of a hydrophilic colloid is coated on a support, the coatings are uneven and deposit or aggregates are present in the colloid layer. The quality of light-sensitive materials is thus extremely degraded.

Furthermore, in their copending application Ser. No. 26,962, filed Apr. 4, 1979, the inventors disclose direct positive silver halide photographic light-sensitive materials containing a fogging agent of the formula:

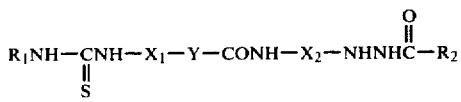

wherein $R_1$, $R_2$, $X_1$, $X_2$ and Y are defined in a manner analogous to the present application. Upon study following their copending application, the inventors found that in some instances, the compounds of the formula (I) of the present invention are more soluble in water than the compounds in their previous application and may be preferred. Also it has been proposed in British Patent Application No. 2,012,443A to use similar compounds having a divalent linking group (—CONH—). Hence, the present invention has followed.

SUMMARY OF THE INVENTION

Accordingly, a first object of the present invention is to provide a direct positive light-sensitive material capable of providing uniform maximum density.

A second object of the present invention is to provide a direct positive light-sensitive material containing a fogging agent which imparts a desired fogging activity without detracting from spectral sensitization.

A third object of the present invention is to provide a direct positive photographic light-sensitive material in which adequate spectral sensitization is provided and direct positive images having uniform and high maximum density are produced.

A fourth object of the present invention is to provide a direct positive photographic light-sensitive material which does not contaminate the developing solution.

A fifth object of the present invention is to provide a direct positive photographic light-sensitive material having less dependency upon the developing temperature.

A sixth object of the present invention is to provide a direct positive photographic light-sensitive material having a uniform hydrophilic colloid layer free from the coating unevenness and providing images having good qualities using a fogging agent which has a good solubility in a solvent.

A seventh object of the present invention is to provide a color diffusion transfer photographic light-sensitive material which has the aforementioned various properties.

The aforementioned objects of the present invention are achieved by incorporating a fogging agent represented by the formula (I) set forth below into at least one hydrophilic colloid layer in a silver halide light-sensitive material, preferably an internal latent image type silver halide photographic emulsion layer or an adjacent hydrophilic colloid layer:

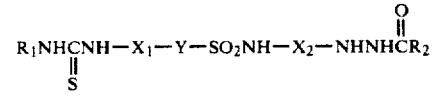

(I)

wherein $R_1$ represents an aliphatic residue or an aromatic residue; $R_2$ represents a hydrogen atom, an aliphatic residue or an aromatic residue; $X_1$ and $X_2$, which may be the same or different, each represents a divalent aromatic residue; and Y represents

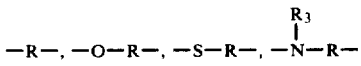

or a direct bond wherein R represents a divalent aliphatic group and $R_3$ represents an aliphatic residue or an aromatic residue.

DETAILED DESCRIPTION OF THE INVENTION

In more detail, the aliphatic residue for $R_1$ and $R_2$ includes a straight chain or branched chain alkyl group, a cycloalkyl group, these groups having a substituent and an alkenyl group (an alkynyl group). The straight chain and branched chain alkyl group for $R_1$ is an alkyl group having 1 to 10 carbon atoms and preferably 1 to 8 carbon atoms. Specific examples thereof include a methyl group, an ethyl group, an isobutyl group, a t-octyl group, etc. The alkyl group for $R_2$ comprises, for example, 1 to 6 carbon atoms, e.g., a methyl group, an ethyl group, a propyl group, etc.

Further, the cycloalkyl group for $R_1$ and $R_2$ comprises, for example, 3 to 10 carbon atoms; specific examples thereof including a cyclopropyl group, a cyclohexyl group, an adamantyl group, etc.

Examples of the substituents for the alkyl group or the cycloalkyl group for $R_1$ and $R_2$ include an alkoxy group preferably having 1 to 6 carbon atoms (e.g., a methoxy group, an ethoxy group, a propoxy group, a butoxy group, etc.), an alkoxycarbonyl group having 2 to 6 carbon atoms, a carbamoyl group, a hydroxy group, an alkylthio group having 1 to 6 carbon atoms, an amido group, an acyloxy group, a sulfonyl group, a halogen atom (e.g., chlorine, bromine, fluorine and iodine), and an aryl group having 6 to 10 carbon atoms (e.g., a phenyl group, a halogen-substituted phenyl group, an alkyl-substituted phenyl group, etc.). Specific examples of the substituted alkyl groups for $R_1$ and $R_2$ are, for example, a 3-methoxypropyl group, an ethoxycarbonylmethyl group, a 4-chlorocyclohexyl group, a benzyl group, a p-methylbenzyl group and a p-chlorobenzyl group.

Further, the alkenyl group for $R_1$ and $R_2$ preferably has 2 to 6 carbon atoms and includes an allyl group and the alkynyl group having 3 to 18 carbon atoms for $R_1$ and $R_2$ includes a propargyl group.

On the other hand, the aromatic residues for $R_1$ and $R_2$ include a phenyl group and a naphthyl group both of which may bear a substituent (for example, an alkyl group having 1 to 6 carbon atoms, an alkoxy group having 1 to 6 carbon atoms, a hydroxy group, a carbamoyl group, a halogen atom, etc.). Specific examples of the substituted aryl group for $R_1$ and $R_2$ include, e.g., a p-methoxyphenyl group, a tollyl group, a p-chlorophenyl group and an m-fluorophenyl group.

The divalent aromatic residues for $X_1$ and $X_2$ include a phenylene group, a naphthylene group and a substituted phenylene group. Examples of the substituents for the substituted phenylene group include an alkyl group having 1 to 6 carbon atoms (e.g., a methyl group, etc.), an aralkyl group having 7 to 12 carbon atoms, an alkoxy group having 1 to 6 carbon atoms, a substituted alkoxy group, a hydroxy group, an amino group, a substituted amino group (e.g., a dimethylamino group or a diethylamino group, etc.), an amido group (e.g., an acetamido group or a propaneamido group, etc.), and a halogen atom (e.g., chlorine, etc.), etc. Of the $X_1$ and $X_2$ groups defined above, a phenylene group is the most preferred. In other words, the divalent connecting group formed between the $$R_1NHC(=S)-NH- \text{ group}$$

and the $$-NHNHC(=O)R_2 \text{ group}$$

is preferably

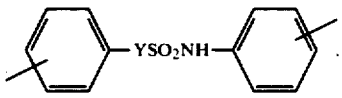

More specifically, the $$R_1NHC(=S)-NH- \text{ group}$$

is connected to the

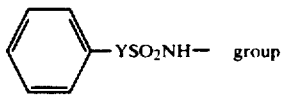

at the meta or para position, and the $$-NHNHC(=O)-R_2 \text{ group}$$

is connected with the

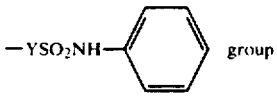

at the meta or para position thereof.

The connecting group Y is $$-R-,\ -O-R-,\ -S-R-,\ -\overset{R_3}{\overset{|}{N}}-R-$$

or a direct bond, and the O and S atom therein is bonded to the residue represented by $X_1$. R represents a divalent aliphatic group and includes a straight chain or branched chain alkylene group and cycloalkylene group and further includes a group containing a double bond or a triple bond besides a saturated bond.

Examples of the straight chain or branched chain alkylene groups for R include an alkylene group having 1 to 5 carbon atoms and preferably 1 to 3 carbon atoms. Specific examples thereof are, for example, $-CH_2-$, $-CH_2CH_2-$, $-CH_2CH_2CH_2-$, $-CH(CH_3)-$, $-CH(CH_2CH_3)-$, etc. Examples of the cycloalkylene groups for R include a cycloalkylene group having 3 to 6 carbon atoms. Specific examples thereof are a 1,2-cyclopropylene group, a 1,4-cyclohexylene group, etc. Specific examples of the groups containing an unsaturated bond include $-CH=CH-$, $-C\equiv C-$, etc., and may have 2 to 6 carbon atoms. An alkylene group having 1 to 4 carbon atoms is preferred for R. Specific examples thereof are $$-CH_2-,\ -CH_2CH_2-,\ -CH_2CH_2CH_2-,\ -CH_2\overset{CH_3}{\overset{|}{C}}H-,$$
$$-CH_2CH_2CH_2CH_2-,\ -CH_2\overset{CH_3}{\overset{|}{C}}HCH_2-,\ -CH_2CH_2\overset{CH_3}{\overset{|}{C}}H-,$$

etc.

The aliphatic residue represented by $R_3$ includes a straight chain or branched chain alkyl group which may be substituted, a cycloalkyl group which may be substituted, an alkenyl group and an alkynyl group. Specific examples of these are, for example, those having 1 to 10 carbon atoms and include a methyl group, an isobutyl group, a cyclohexyl group, an allyl group, etc. Examples of the substituents include an alkoxy group, a hydroxy group, an alkoxycarbonyl group, a carbamoyl group, an amido group, a halogen atom, an aryl group, etc., as illustrated for the alkyl groups represented by $R_1$ and $R_2$ above.

The aromatic residue for $R_3$ includes a phenyl group which may be substituted. The substituents for the phenyl group include an alkyl group, an alkoxy group, a hydroxy group, a halogen atom, etc., as illustrated for the aromatic residues represented by $R_1$ and $R_2$ above.

When the fogging agent of the present invention is employed, the following various effects are obtained.

(1) The temperature-dependency of processing is less.

(2) No deterioration of images due to evolution of nitrogen gas is encountered.

(3) The amount of the fogging agent employed is reduced.

(4) Adsorption capability of the silver halide is strong so that fogging activity effectively occurs. (The amount of fogging agent employed may be reduced and, thus, spectral sensitization is not damaged.)

(5) Visible light is not absorbed such that no desensitization is created.

(6) Solubility in a solvent is large so that the fogging agent can be incorporated into a hydrophilic colloid layer using a small amount of organic solvents and, thus, a uniform hydrophilic colloid layer free from unevenness, deposits and aggregates is obtained.

Specific examples of the fogging agents which are effective in the present invention are illustrated below. However, the present invention is not limited to the use of these compounds.

Compound 1
1-Formo-2-{4-[3-(3-phenylthioureido)benzenesulfonamido]phenyl}hydrazide Compound 2
1-Formo-2-{3-[3-(3-phenylthioureido)benzenesulfonamido]phenyl}hydrazide Compound 3
1-Aceto-2-{4-[4-(3-phenylthioureido)benzenesulfonamido]phenyl}hydrazide Compound 4
1-Formo-2-{3-[4-(3-phenylthioureido)benzenesulfonamido]phenyl}hydrazide Compound 5
1-Formo-2-{4-[2-(2-methoxyethoxy)-5-(3-phenylthioureido)benzenesulfonamido]phenyl}hydrazide Compound 6
2-{4-[5-(3-Ethylthioureido)-2-morpholinobenzenesulfonamido]phenyl}-1-formylhydrazide Compound 7
1-Aceto-2-{4-[3-(3-cyclohexylthioureido)benzenesulfonamido]phenyl}hydrazide Compound 8
1-Benzo-2-<3-{3-[3-(4-chlorophenyl)thioureido]-benzenesulfonamido}phenyl>hydrazide Compound 9
2-<4-{2-[4-(3-allylthioureido)phenyl]ethanesulfonamido}phenyl>-1-formohydrazide Compound 10
1-Aceto-2-<4-{3-[4-(3-phenylthioureido)phenoxy]-propanesulfonamido}phenyl>hydrazide Compound 11
1-Formo-2-<4-{4-[4-(3-phenylthioureido)phenylthio]-butanesulfonamido}phenyl>hydrazide Compound 12
2-<4-<3-{N-[4-(3-ethylthioureido)phenyl]-N-methylamino}propanesulfonamido>phenyl>-1-formohydrazide A general synthetic method for forming the fogging agent employed in the present invention is described below. By reacting 4- or 3-nitrophenylhydrazine with formic acid or a corresponding acid anhydride or acid chloride, 1-formo-2-(4- or 3-nitrophenyl)hydrazide or the corresponding 1-acylo-2-(4- or 3-nitrophenyl)hydrazide can be obtained. By catalytically reducing with hydrogen gas the nitrophenylhydrazine in a solvent such as an alcohol, for example, ethanol, methyl Cellosolve, etc., or dioxane, in the presence of palladium-carbon as a catalyst or by heating the nitrophenylhydrazine with reduced iron in an alcohol, a corresponding 4- or 3-aminophenylhydrazine can be obtained with ease. The 4- or 3-aminophenylhydrazine can be converted into a corresponding nitrobenzene-, nitrophenylalkane-, nitrophenylthioalkane-, nitrophenoxyalkane- or nitrophenylaminoalkane-sulfonic acid amido phenylhydrazide by reacting it with a 4- or 3-nitrobenzenesulfonyl chloride, 4- or 3-nitrophenylalkanesulfonyl chloride, 4- or 3-nitrophenylthioalkanesulfonyl chloride, 4- or 3-nitrophenoxyalkanesulfonyl chloride or 4- or 3-nitrophenylaminoalkanesulfonyl chloride in the presence of an acid-eliminating agent. After converting the nitro group into an amino group by catalytic reduction or with reduced iron as described above, the amino compound is reacted with an arylisothiocyanate such as phenylisothiocyanate, etc., or an alkyl or alkenylisothiocyanate such as allylisothiocyanate, ethylisothiocyanate, etc., to obtain the object compound.

Specific synthesis examples are illustrated below.

(1) 2-(4-Nitrophenyl)formohydrazide

To 1.6 l of acetonitrile was added 459 g of 4-nitrophenylhydrazine. Then, 322 g of formic acid was slowly added to the mixture to produce a homogeneous solution. Crystals precipitated 20 minutes later. After the reaction continued for another 2 hours at 80° C. inner temperature, the system was cooled. The crystals were removed by filtration and washed with acetonitrile. After drying, 493 g of 2-(4-nitrophenyl)formohydrazide was obtained. m.p.: 184° to 186° C.

(2) 2-(4-Aminophenyl)formohydrazide

In 1,600 ml of ethanol, 30 g of 2-(4-nitrophenyl)formohydrazide was catalytically reduced at room temperature in the presence of a palladium-carbon catalyst. The reaction liquid was filtered and the filtrate was evaporated to dryness to obtain 20.5 g of white solid 2-(4-aminophenyl)formohydrazide. m.p.: 123° to 125° C.

(3) 2-(3-Nitrophenyl)formohydrazide

3-Nitrophenylhydrazine was reacted in a manner similar to Preparation (1) above to obtain 430 g of 2-(3-nitrophenyl)formohydrazide. m.p.: 168° to 169° C.

(4) 2-(3-Aminophenyl)formohydrazide 2-(3-Nitrophenyl)formohydrazide was reacted in a manner similar to Preparation (2) above to obtain 21.0 g of 2-(3-aminophenyl)formohydrazide. m.p.: 108° to 113° C.

(5) 2-(4-Nitrophenyl)benzohydrazide

In 200 ml of benzene was dissolved 30 g of 4-nitrophenylhydrazine and 45 g of anhydrous benzoic acid. The solution was heated under reflux for 3 hours. The reaction solution was poured into ice water. The resulting product was taken out by filtration, washed with ethanol and dried to obtain 40 g of 2-(4-nitrophenyl)-benzohydrazide. m.p.: 194° to 196° C.

(6) 2-(4-Aminophenyl)benzohydrazide 2-(4-Nitrophenyl)benzohydrazide was catalytically reduced in a manner similar to Preparation (2) above to obtain 22 g of 2-(4-aminophenyl)benzohydrazide. m.p.: 135° to 137° C.

(7) 2-[4-(3-Nitrobenzenesulfonamido)phenyl]formohydrazide 15.1 g of 2-(4-aminophenyl)formohydrazide and 14 ml of triethylamine were dispersed in 50 ml of acetonitrile. To the dispersion, a solution containing 50 ml of acetonitrile and 22.1 g of 3-nitrobenzenesulfonyl chloride was added dropwise while stirring at room temperature. After heating at 60° C. for 2 hours, the reaction mixture was cooled and then poured into water. The resulting crystals were collected by filtration. 15 g of 2-[4-(3-nitrobenzenesulfonamido)phenyl]formohydrazide was obtained. m.p.: 188° to 191° C.

(8) Synthesis of Compound 1

To a mixture of 8.4 g of iron powder, 0.8 g of ammonium chloride, 150 ml of isopropyl alcohol and 15 ml of water, while heating under refluxing, 5.0 g of 1-formo-2-[4-(3-nitrobenzenesulfonamido)phenyl]hydrazide was added. The mixture was heated under reflux for 20 minutes. The reaction liquid was filtered and to the filtrate was added 4.1 g of phenyl isothiocyanate. The mixture was reacted at 45° C. for 2 hours. After cooling, 150 ml of water was added to the mixture to separate a gummy product. After decantation, the product was purified by a silica gel chromatography using ethyl acetate as a spreading agent to obtain 4.5 g of glass-like solid object compound.

(9) Synthesis of Compound 5

15.1 g of 2-(4-aminophenyl)formohydrazide and 10.6 g of triethylamine were dissolved in 50 ml of dimethylacetamide. To the solution was added 29.6 g of 2-(2-methoxyethoxy)-5-nitrobenzenesulfonyl chloride under cooling with ice with stirring for 15 minutes. After reacting under cooling with ice for 1.5 hours, 250 ml of water was added to the reaction liquid to separate a rice cake-like sulfonamide compound. Decantation and washing with water were repeated twice. To a mixture of 40 g of iron powder, 3 g of ammonium chloride, 150 ml of isopropyl alcohol and 20 ml of water, while heating under refluxing, a solution of the above-described nitro compound dissolved in 150 ml of isopropyl alcohol was added. After heating under refluxing for 2 hours, the reaction liquid was filtered. To the filtrate, 13.5 g of phenylisothiocyanate was added and the mixture was reacted at 40° C. for 3 hours. The reaction liquid was condensed under reduced pressure and purified by a silica gel column chromatography using ethyl acetate as a spreading agent to obtain 17 g of glass-like solid object compound. m.p.: 70° to 90° C.

The other compounds can be synthesized in a manner similar to the above synthesis examples.

In the direct positive light-sensitive material of the present invention, it is preferred that the compound represented by the formula (I) be incorporated into an internal latent image type silver halide emulsion, however, the compound can also be incorporated into a hydrophilic colloid layer contiguous to an internal latent image type silver halide emulsion layer. Such a layer can be any layer of a light-sensitive layer, an intermediate layer, a filter layer, a protective layer, an antihalation layer, etc., having any function, as long as the fogging agent is not prevented from diffusing into the internal latent image type silver halide emulsion.

It is desired that the fogging agent of the present invention in layers be present in an amount that gives a suitable maximum density (for example, above 2.0) when the internal latent image type emulsion is developed by a surface developing solution. For practical purposes, the appropriate content will vary over a wide range depending upon the characteristics of silver halide emulsion, the chemical structure of the fogging agent and the developing conditions. Nevertheless, a range of from about 0.1 mg to 1,000 mg per mol of silver halide in the internal latent image type silver halide emulsion is practically effective, preferably about 0.5 mg to about 700 mg per mol of silver halide. Where the fogging agent is incorporated into the hydrophilic colloid layer contiguous to the emulsion layer, it is adequate to incorporate the fogging agent in the above amount based on the amount of silver contained in the associated internal latent image type emulsion layer.

Internal latent image type silver halide emulsions are already shown by Davey et al (U.S. Pat. No. 2,592,250) and described in other references. The internal latent image type silver halide emulsion can be clearly distinguished by the fact that the maximum density achieved in the case of developing it with an "internal type" developing solution is greater than the maximum density achieved in the case of developing it with a "surface type" developing solution. The internal latent image type emulsion which is suitable for the present invention has a maximum density (measured by an ordinary photographic density measurement methods) when coated onto a transparent support and exposed to light a fixed time period of between 0.01 to 1 second and then developed with Developing Solution A indicated below (an internal type developing solution) at 20° C. for 3 minutes, greater by at least 5 times than the maximum density obtained in the case of developing the silver halide exposed as described above with Developing Solution B indicated below (a surface type developing solution) at 20° C. for 4 minutes.

| | |
|---|---|
| Developing Solution A: | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |
| Developing Solution B: | |
| p-Oxyphenylglycine | 10 g |
| Sodium Carbonate | 100 g |
| Water to make | 1 l |

As internal latent image type emulsions which are suitable for the objects of the present invention, there can be employed the emulsions described in British Pat. No. 1,027,146, U.S. Pat. Nos. 3,206,313, 3,511,662, 3,447,927, 3,737,313, 3,761,276, 3,271,157, etc., in addition to the emulsion described in U.S. Pat. No. 2,592,250 referred to above. However, the emulsions of the present invention are not limited to these.

A variety of direct positive photographic techniques are known including the use of silver halide grains which have been previously fogged and the use of internal latent image type silver halide grains which have not been previously fogged. The latter is preferred in the present invention in view of the higher sensitivity which is achieved.

In the direct positive photographic light-sensitive material of the present invention, a variety of hydrophilic colloids can be employed as a binder.

As colloids employed for this purpose, there can be listed hydrophilic colloids conventionally employed in the photographic field, such as gelatin, colloidal albumin, polysaccharides, cellulose derivatives, synthetic resins, polyvinyl compounds including, e.g., polyvinyl alcohol derivatives, acrylamide polymers, etc. Hydrophobic colloids, e.g., dispersed polymerized vinyl compounds, particularly those that increase dimensional stability of photographic materials, can also be incorporated together with the hydrophilic colloid. Suitable examples of this type of compounds include water-insoluble polymers prepared by polymerizing vinyl monomers such as alkyl acrylates, alkyl methacrylates, acrylic acid, sulfoalkyl acrylates, sulfoalkyl methacrylates, etc.

A variety of photographic supports can be employed in the light-sensitive material of the present invention. The silver halide emulsion can be coated onto one side or both sides of the support.

In the light-sensitive material of the present invention, the photographic silver halide emulsion layers and other hydrophilic colloid layers can be hardened with an appropriate hardening agent. Examples of these hardening agents include vinylsulfonyl compounds as described in Japanese Patent Application (OPI) Nos. 76025/78, 76026/78 and 77619/78, hardening agents having active halogen, dioxane derivatives, oxypolysaccharides such as oxy starch, etc.

The photographic silver halide emulsion layer can contain other additives, particularly those useful for photographic emulsion, e.g., lubricants, stabilizers, sensitizers, light absorbing dyes, plasticizers, etc.

In addition, in the present invention compounds which release iodine ions (such as potassium iodide) can be incorporated into the silver halide emulsion and, furthermore, the desired image can be obtained using a developing solution containing iodine ions.

The light-sensitive material of the present invention can contain surface active agents for a variety of purposes. Depending upon purpose, any one of nonionic, ionic and amphoteric surface active agents can be employed, which are exemplified by, e.g., polyoxyalkylene derivatives, amphoteric amino acids (including sulfobetaines), etc. Examples of such surface active agents are described in U.S. Pat. Nos. 2,600,831, 2,271,622, 2,271,623, 2,275,727, 2,787,604, 2,816,920 and 2,739,891, Belgian Pat. No. 652,862, etc.

In the light-sensitive material of the present invention, the photographic emulsion can be spectrally sensitized with sensitizing dyes to blue light of relatively long wavelengths, green light, red light or infrared light. As sensitizing dyes, there can be employed cyanine dyes, merocyanine dyes, complex cyanine dyes, complex merocyanine dyes, holopolar cyanine dyes, styryl dyes, hemicyanine dyes, oxonol dyes, hemioxonol dyes, etc.

Useful sensitizing dyes which can be employed in accordance with the present invention are described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73, Belgian Pat. No. 691,807, etc.

The sensitizing dyes employed in the present invention are used in a concentration almost equivalent to that used in ordinary negative silver halide emulsion. In particular, it is advantageous that the sensitizing dyes be employed in a dye concentration to a degree that does not substantially cause desensitization in the region of intrinsic density of silver halide emulsion. It is preferred that the sensitizing dyes be employed in a concentration of about $1.0\times10^{-5}$ to about $5\times10^{-4}$ mol per mol of silver halide, particularly in a concentration of about $4\times10^{-5}$ to $2\times10^{-4}$ mol per mol of silver halide.

Dye image-forming couplers can be incorporated into the light-sensitive material of the present invention. Alternatively, the light-sensitive material can also be developed with a developing solution containing a dye image-forming coupler. In order to incorporate a color forming agent into the silver halide emulsion of the present invention, known methods can optionally be employed. For example, methods as described in U.S. Pat. Nos. 1,055,155, 1,102,028, 2,186,849, 2,322,027 and 2,801,171 can be employed. In the present invention, developing agents, e.g., polyhydroxybenzenes, aminophenols, 3-pyrazolidones, etc., can also be incorporated in emulsion or light-sensitive material. In the present invention, the photographic emulsion can be unhardened, or can also contain tanning developing agents such as hydroquinone, catechol, etc.

The photographic emulsion of the present invention can also be utilized for obtaining desired transfer images on an image-receiving layer after appropriate development processing, in combination with a dye image-providing material for diffusion transfer capable of releasing diffusible dyes in response to development of silver halide. As such a dye image-providing material for diffusion transfer, a number of compounds are known and such as the compounds described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, Published U.S. Patent Application No. B 351,673, British Pat. Nos. 840,731, 904,364 and 1,038,331, German Patent Application (OLS) Nos. 1,930,215, 2,214,381, 2,228,361, 2,317,134 and 2,402,900, French Pat. No. 2,284,140, Japanese Patent Application (OPI) No. 113624/76 (corresponding to U.S. Pat. No. 4,055,428) and Japanese Patent Application (OPI) No. 104343/76, Japanese Patent Application Nos. 64533/77 and 58318/77, etc., can be employed. Of these, it is preferred that dye image-providing materials of type which are first non-diffusible and, after the oxidation-reduction reaction with the oxidation product of the developing agent, cleave to release diffusible dyes (hereafter referred to as DRR compounds) be employed.

In particular, preferred compounds for use in combination with the fogging agent of the present invention are DRR compounds having an o-hydroxyarylsulfamoyl group as described in the aforementioned U.S. Pat. No. 4,055,428, or DRR compounds having a redox mother nucleus as described in the above-mentioned Japanese Patent Application (OPI) No. 64533/77 corresponding to U.S. Application Ser. No. 911,571, filed June 1, 1978. If the fogging agent is employed in combination with such DRR compounds, the temperature dependency of processing is markedly reduced.

Specific examples of DRR compounds include, in addition to those as described in the above-described patent publications, 1-hydroxy-2-tetramethylenesulfamoyl 4-[3'-methyl-4'-(2''-hydroxy-4''-methyl-5''-hexadecyloxyphenylsulfamoyl)phenylazo]naphthalene as a magenta dye-forming substance, 1-phenyl-3-cyano-4-{3'-[2'-hydroxy-4''-methyl-5''-(2'''''',4'''''''-di-t-pentylphenoxyacetamino)phenylsulfamoyl]phenylazo}-5-pyrazolone as a yellow dye image-forming substance, etc.

For developing the light-sensitive material of the present invention, a variety of known developing agents can be employed. That is, polyhydroxybenzenes, e.g., hydroquinone, 2-chlorohydroquinone, 2-methylhydroquinone, catechol, pyrogallol, etc.; aminophenols, e.g., p-aminophenol, N-methyl-p-aminophenol, 2,4-diaminophenol, etc.; 3-pyrazolidones, e.g., 1-phenyl-3-pyrazolidones, 4,4-dimethyl-1-phenyl-3-pyrazolidone, 5,5-dimethyl-1-phenyl-3-pyrazolidone, etc.; ascorbic acids, and the like can be employed singly or as combination thereof. In addition, to obtain dye images in the presence of dye-forming couplers, aromatic primary amine developing agents, preferably p-phenylenediamine type developing agents can be used. Specific examples thereof include 4-amino-3-methyl-N,N-diethylaniline hydrochloride, N,N-diethyl-p-phenylenediamine, 3-methyl-4-amino-N-ethyl-N-β-(methanesulfonamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline. Such developing agents can be incorporated into alkaline processing compositions (processing element) or can also be incorporated into appropriate layers of the light-sensitive element.

In the case of using DRR compound in the present invention, any silver halide developing agent can be employed as long as the agent is able to cross-oxidize the DRR compounds.

The developing solution can contain, as a preservative, sodium sulfite, potassium sulfite, ascorbic acid, reductones (e.g., piperidinohexose reductone), etc.

The light-sensitive material of the present invention can provide direct positive images by developing the material using a surface developing solution. The surface developing solution induces the development process substantially with latent images or fogging nuclei present on the surface of silver halide grains. Though it is preferred not to contain any silver halide dissolving agent in the developing solution, a small amount of the silver halide dissolving agent (e.g., sulfites) can be contained in the developing solution as long as internal latent images do not substantially contribute to development until the development due to the surface development center of silver halide grains is completed.

The developing solution can contain, as an alkali agent and a buffering agent, sodium hydroxide, potassium hydroxide, sodium carbonate, potassium carbonate, trisodium phosphate, sodium metaborate, etc. The amount of these agents is selected so as to render the pH of the developing solution to 10 to 13, preferably pH to 11 to 12.5.

The developing solution can also contain color development accelerators such as benzyl alcohol, or the like. Further, it is advantageous that the developing solution contains, in order to lessen the reduction in the minimum density of direct positive images, compounds which are usually employed as anti-fogging agents, for example, benzimidazoles, e.g., 5-nitrobenzimidazole; benzotriazoles, e.g., benzotriazole, 5-methylbenzotriazole, etc.

The light-sensitive material of the present invention can also be processed with a viscous developing solution.

The viscous developing solution is a liquid state composition in which processing components necessary for development of silver halide emulsion and for formation of diffusion transfer dye images are contained; a major component of the solvent is water and in addition thereto, hydrophilic solvents such as methanol, methyl Cellosolve, etc., are contained therein in some cases. The processing composition contains an alkali in an amount sufficient to maintain pH necessary for developing the emulsion layer(s) and to neutralize acids (e.g., hydrohalic acids such as hydrobromic acid, carboxylic acids such as acetic acid, etc.) formed during various processings for development and formation of dye images. As alkalis, there may be employed alkali metal or alkaline earth metal salts, or amines such as lithium hydroxide, sodium hydroxide, potassium hydroxide, calcium hydroxide dispersion, hydroxylated tetramethyl ammonium, sodium carbonate, trisodium phosphate, diethylamine, etc. It is desired that alkali hydroxides be incorporated in the developing solution in such an amount as having a pH of preferably about 12 or more at room temperature, more preferably a pH of 14 or more for color diffusion transfer photography. More preferably, the processing composition contains hydrophilic polymers of high molecular weight, such as polyvinyl alcohol, hydroxyethyl cellulose, sodium carboxymethyl cellulose. It is desired that these polymers be employed so as to impart viscosity above 1 poise at room temperature preferably several hundreds (500 to 600) to 1,000 poise, to the processing composition.

Further, it is advantageous particularly in the case of a mono sheet film unit that the processing composition contain light absorbing agents such as $TiO_2$, carbon black, pH-indicating dyes for preventing the silver halide emulsion from fogging due to outside light during or after processing, or desensitizers as described in U.S. Pat. No. 3,579,333. In addition, developing inhibitors such as benzotriazole can be incorporated into the processing composition.

It is preferred that the above-described viscous processing composition be employed in a rupturable container as described in U.S. Pat. Nos. 2,543,181, 2,643,886, 2,653,732, 2,723,051, 3,056,491, 3,056,492, 3,152,515, etc.

Where the light-sensitive material of the present invention is employed for diffusion transfer photography, it is preferred that the light-sensitive material be in the form of a film unit. A photographic film unit, that is, a film unit designed so as to enable processing by passing the film unit between a pair of side-by-side disposed pressing materials basically comprises the three elements below:

(1) a light-sensitive element containing the fogging agent of the present invention, (2) an image-receiving element, and (3) the processing element, e.g., which contains a means for releasing the alkaline processing composition in the film unit such as a rupturable container and contains the silver halide developing agent.

A preferred embodiment of this photographic film unit is a type unified by laminating and the type disclosed in Belgian Pat. No. 757,959. According to this embodiment, the film unit comprises a transparent support having coated thereon, in succession, an image-receiving layer, a substantially opaque light reflective layer (e.g., a $TiO_2$ layer and a carbon black layer), and a light-sensitive element comprising single or plural silver halide light-sensitive layers in combination with DRR compounds, and further thereon laminated a transparent cover sheet. A rupturable container containing an alkaline processing composition comprising an opacifying agent (e.g., carbon black) is disposed adjacent to the outermost layer of the abovedescribed light-sensitive layers and the transparent cover sheet. Such a film unit is exposed to light through the transparent cover sheet, upon taking the unit out of a camera, the container is ruptured by the pressing materials to thereby develop the processing composition (containing the opacifying agent) is spread over the entire surface between a protective layer on the light-sensitive layers and the cover sheet. By doing this, the film unit is shielded from light as development proceeds. It is preferred that a neutralizing layer and further, if necessary, a neutralizing rate controlling layer (timing layer) be coated, in succession, onto a support of the cover sheet.

In addition, other useful embodiments utilizing laminate layers in which DRR compounds or diffusible dye releasing couplers are employed are described in U.S. Pat. Nos. 3,415,644, 3,415,645, 3,415,646, 3,647,487 and 3,635,707, German Patent Application (OLS) No. 2,426,980, etc.

The present invention will be further explained by reference to the examples below. However, the present invention is not limited thereto.

EXAMPLE 1

Using Compounds 1 and 5 described hereinbefore according to the present invention, Compound B: 1-[4-(2-formylhydrazino)phenyl]-3-phenylthiourea which is described in U.S. Pat. No. 4,030,925, Compound C: 1-formo-2-<4-{2-[3-(3-phenylthioureido)-phenoxy]acetamido}phenyl>hydrazide, Compound D: 1-formo-2-<4-{2-[4-(3-phenylthioureido)-phenoxy]acetamido}phenyl>hydrazide, Compound E: 2-<4-{2-[4-(3-ethylthioureido)phenoxy]-acetamido}phenyl>-1-formohydrazide, and Compound F: 1-formo-2-{4-[3-(3-phenylthioureido)-benzamido]-phenyl}hydrazide, the comparison of solubility was carried out.

Methanol, ethanol, acetone and ethyl acetate were selected for solvents. The solvent was put into a measuring flask in an amount of 100 ml. Then each of compounds 1, 5 and B to F were added to the measuring flask in an amount ranging from 0.01 g to 10 g. The measuring flasks were put into an ultrasonic washing machine ("Cleaner, Ultrasonic 220" manufactured by Branson Co.) and ultrasonic wave was applied to for 5 minutes to promote dissolution of the compound except the measuring flasks in which dissolution of the compound was visually observed at room temperature (about 25° C.) just after the addition of the compound. The temperature of the solvent rose slightly due to the application of ultrasonic wave. After the application of ultrasonic wave, the measuring flasks were taken out from the ultrasonic washing machine and whether the compound dissolved or not was judged visually after the solvent cooled to room temperature. The results are shown in Table 1 below.

TABLE 1

| | Solvent | | | |
|---|---|---|---|---|
| Compound | Methanol (%) | Ethanol (%) | Acetone (%) | Ethyl Acetate (%) |
| 1 | 10 or more | 3.3 | 10 or more | 2 |
| 5 | 5 | 2 | 10 | 0.5 |
| B | 0.05 | 0.01 | 0.05 | insoluble |
| C | 0.01 or less | 0.01 or less | 0.01 | 0.01 or less |
| D | 0.01 or less | 0.01 or less | 0.01 or less | 0.01 or less |
| E | 0.1 | 0.01 or less | 0.02 | 0.01 or less |
| F | 0.03 | 0.01 or less | 0.03 | 0.01 or less |

From the results shown in Table 1 above, it is apparent that Compounds 1 and 5 according to the present invention have an excellent solubility in comparison with Compounds B to F.

EXAMPLE 2

Onto a polyethylene terephthalate transparent support were coated in succession the following layers below to prepare three kinds of light-sensitive sheets (A) to (C).

(1) A mordant layer containing the polymer (3.0 g/m$^2$) described in U.S. Pat. No. 3,898,088 and having the repeating unit indicated below:

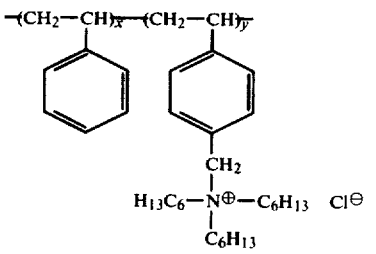

x:y = 50:50 and gelatin (3.0 g/m$^2$).

(2) A white reflective layer containing 20 g/m$^2$ of titanium oxide and 2.0 g/m$^2$ of gelatin.

(3) A light-shielding layer containing 2.70 g/m$^2$ of carbon black and 2.70 g/m$^2$ of gelatin.

(4) A layer containing the magenta DRR compound (0.45 g/m$^2$) indicated below, diethyllaurylamide (0.10 g/m$^2$), 2,5-di-t-butylhydroquinone (0.0074 g/m$^2$) and gelatin (0.76 g/m$^2$).

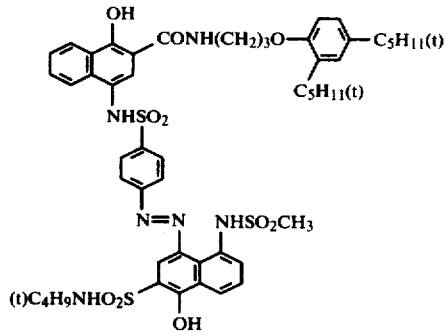

(5) A layer containing green sensitive internal latent image type direct positive silver iodobromide emulsion (internal latent image type emulsion prepared in the same manner as described in U.S. Pat. No. 3,761,276; halide composition in the silver halide: 2 mol% iodide; 1.4 g/m$^2$ calculated as the amount of silver, 1.0 g/m$^2$ of gelatin), sodium 5-pentadecylhydroquinone-2-sulfonate (0.11 g/m$^2$), and a fogging agent in an amount indicated below:

| | | |
|---|---|---|
| Light-sensitive sheet (A) | None | — |
| Light-sensitive sheet (B) | Compound 1 | 4.6 mg/mol of Ag |
| Light-sensitive sheet (C) | Compound 5 | 4.1 mg/mol of Ag |

(6) A layer of gelatin (0.94 g/m$^2$).

The above-described light-sensitive sheets (A) to (C) were processed in combination with each element shown below.

| Processing Solution: | |
|---|---|
| 1-Phenyl-4-methyl-4-hydroxymethyl-3-pyrazolidone | 10 g |
| Methylhydroquinone | 0.18 g |
| 5-Methylbenzotriazole | 4.0 g |
| Sodium Sulfite (anhydrous) | 1.0 g |
| Carboxymethyl Cellulose Na Salt | 40.0 g |
| Carbon Black | 150 g |

-continued

| Processing Solution: | |
|---|---|
| Potassium Hydroxide (28% aq. soln.) | 200 cc |
| $H_2O$ | 550 cc |

0.8 g of the processing solution of the above composition was filled into each pressure rupturable container.

Cover Sheet:

Onto a polyethylene terephthalate support were coated an acid polymer layer (neutralizing layer) containing 15 g/m$^2$ of polyacrylic acid (a 10 wt% aqueous solution having viscosity of about 1,000 cp), a neutralization timing layer containing 3.8 g/m$^2$ of acetyl cellulose (hydrolysis of 100 g of the acetyl cellulose forms 39.4 g of acetyl groups), and 0.2 g/m$^2$ of a styrene-maleic anhydride copolymer (composition (molar) ratio: styrene: maleic anhydride is about 60:40, molecular weight: about 50,000) thereon to thereby prepare a cover sheet.

Processing Step:

The above-described cover sheet was laminated on the above-described light-sensitive sheet. Exposure was performed through a color test chart from the cover sheet side. Thereafter, the processing solution described above was spread between both sheets in a thickness of 75 microns (with assistance of a pressure roller). The processing was carried out at 25° C. After processing, the green density of the images formed on the image-receiving layer was measured 1 hour after the processing through the transparent support of the light-sensitive sheet using a Macbeth reflection densitometer. The results thereof are shown in Table 2.

It is apparent from the results shown in Table 2 that the compounds of the present invention act as excellent fogging agents.

TABLE 2

| Light-Sensitive Element | $D_{max}$ | $D_{min}$ |
|---|---|---|
| A | 0.29 | 0.26 |
| B | 2.04 | 0.28 |
| C | 1.96 | 0.27 |

EXAMPLE 3

Onto a polyethylene terephthalate transparent support, the following layers were coated in succession to prepare a light-sensitive sheet (D).

(1) The mordant layer in Example 2.

(2) The white reflective layer in Example 2.

(3) The light-shielding layer in Example 2.

(4) A layer containing a cyan DRR compound (0.5 g/m$^2$) indicated below, diethyllauryl amine (0.25 g/m$^2$) and gelatin (1.14 g/m$^2$).

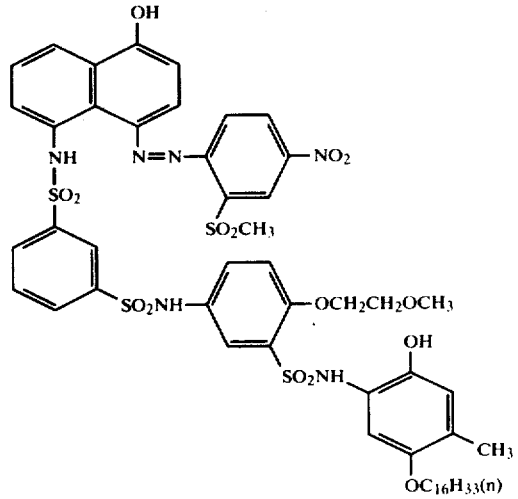

(5) A layer containing red sensitive internal latent image type direct positive silver iodobromide emulsion (internal latent image type emulsion prepared in accordance with the method described in U.S. Pat. No. 3,761,276; halide composition in the silver halide: 2 mol% iodide; 1.9 g/m$^2$ calculated as the amount of silver, 1.4 g/m$^2$ of gelatin), Fogging Agent A in the amount indicated in Table 3 below, and sodium 5-pentadecylhydroquinone-2-sulfonate (0.13 g/m$^2$).

(6) A layer containing gelatin (2.6 g/m$^2$) and 2,5-dioctylhydroquinone (1.0 g/m$^2$).

(7) The layer the same as layer (4) of Example 2 except containing the magenta DRR compound indicated below:

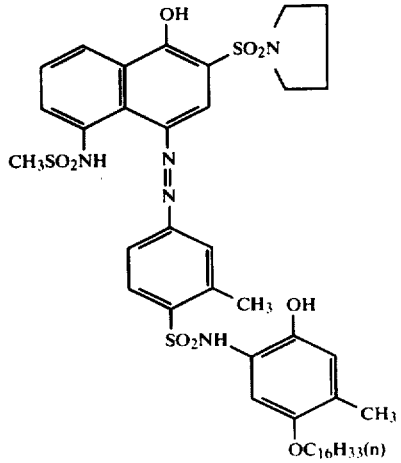

(8) A green sensitive internal latent image type direct positive emulsion layer as in Example 2 except containing Fogging Agent A in the amount indicated in Table 3 below.

(9) The layer same as layer (6) described above.

(10) A layer containing the yellow DRR compound (0.78 g/m$^2$) indicated below, diethyllauryl amide (0.16 g/m$^2$), 2,5-di-t-butylhydroquinone (0.012 g/m$^2$) and gelatin (0.78 g/m$^2$).

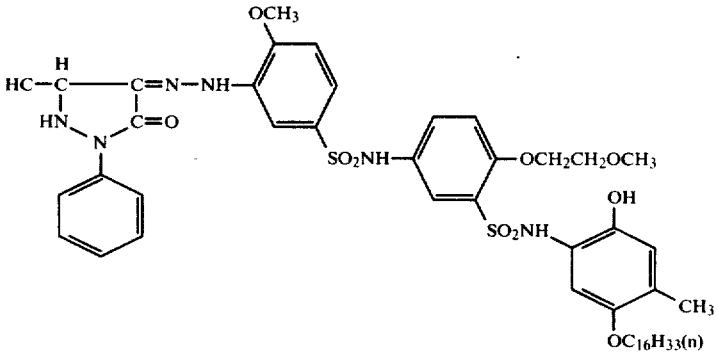

(11) A layer containing blue sensitive internal latent image type direct positive silver iodobromide emulsion (internal latent image type emulsion prepared in accordance with the method described in U.S. Pat. No. 3,761,276; halide composition in the silver halide: 2 mol% iodide; 2.2 g/m$^2$ calculated as the amount of silver, 1.7 g/m$^2$ of gelatin), Fogging Agent A (in an amount indicated in Table 3 below) and sodium 5-pentadecylhydroquinone-2-sulfonate (0.094 g/m$^2$).

(12) A layer containing gelatin (0.94 g/m$^2$).

Further, light-sensitive sheets (E) and (F) were prepared in a manner similar to light-sensitive sheet (D) except that Fogging Agent B and Compound 1 of the present invention were employed instead of Fogging Agent A in the layers (5), (8) and (11) described above.

TABLE 3

| Light-Sensitive Element | Fogging Agent | Amount Added (mg/mol Ag) Blue Sensitive Layer | Green Sensitive Layer | Red Sensitive Layer |
|---|---|---|---|---|
| D | Fogging Agent A | 1,700 | 1,500 | 2,000 |
| E | Fogging Agent B | 10 | 9.5 | 12 |
| F | Compound 1 | 5.6 | 4.7 | 7.5 |

Fogging Agent A (for comparison)

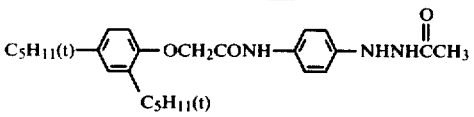

Fogging Agent B (for comparison)

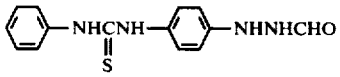

Compound 1 (this invention)

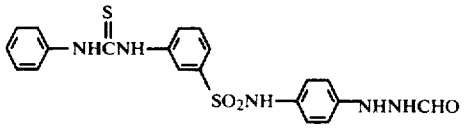

Processing Solution:

The same processing solution used in Example 2.

Cover Sheet:

Onto a polyethylene terephthalate support, the following coatings were applied in succession.

(1) In 1 kg of a 20% solution of an acrylic acid-butyl acrylate (8:2 in a molar ratio) copolymer having average molecular weight of 50,000 (solvent: acetone-water=3:1 (in a volume ratio)) was dissolved 3.8 g of 5-(2-cyanoethylthio)-1-phenyltetrazole. The solution was coated in an amount of 110 g per 1 m$^2$ to obtain a layer having a thickness of about 20 microns.

(2) In an acetone-cyclohexane (3:1 in a volume ratio) solvent mixture were dissolved 55 g of cellulose acetate having acetylation degree of 52.1% (the weight of acetic acid released by hydrolysis was 0.521 g per 1 g of the sample, and 5 g of a styrene-maleic anhydride (1:1 in a molar ratio) copolymer having average molecular weight of 10,000. The solution so obtained was coated in an amount of 50 g per 1 m$^2$ to obtain a layer having a thickness of about 2.6 microns.

(3) Using a solution (10% solution as solid component) of a polymer latex obtained by emulsion-polymerizing styrene-butyl acrylate-acrylic acid in a weight ratio of 52:42:6, coating was made in an amount of 30 cc per 1 m$^2$.

Processing Step:

The above-described cover sheet was laminated on the above-described light-sensitive sheet. Imagewise exposure was performed through a continuous gradation wedge from the cover sheet side. Thereafter, the above-described processing solution was spread in a thickness of 80 microns with the assistance of a pressure roller. The process was performed at 15° C., 25° C. and 35° C., respectively. After processing, the photographic properties of the color positive images obtained with the respective sheets are shown in Table 4.

TABLE 4

| Light-Sensitive Sheet | | Photographic Property $D_{max}$ 15° C. | 25° C. | 35° C | $D_{min}$ 15° C. | 25° C. | 35° C. | Srel* 15° C. | 25° C. | 35° C. |
|---|---|---|---|---|---|---|---|---|---|---|
| | B** | 1.32 | 1.78 | 1.92 | 0.22 | 0.24 | 0.26 | 122 | 100 | 85 |
| D | G | 1.50 | 1.81 | 2.03 | 0.25 | 0.24 | 0.27 | 123 | 100 | 81 |
| | R | 1.49 | 1.96 | 2.07 | 0.35 | 0.37 | 0.38 | 134 | 100 | 78 |
| | B | 1.72 | 1.70 | 1.69 | 0.23 | 0.25 | 0.27 | 92 | 100 | 109 |
| E | G | 1.85 | 1.76 | 1.75 | 0.24 | 0.26 | 0.27 | 75 | 100 | 114 |

TABLE 4-continued

| Light-Sensitive Sheet | | Photographic Property $D_{max}$ 15° C. | $D_{max}$ 25° C. | $D_{max}$ 35° C. | $D_{min}$ 15° C. | $D_{min}$ 25° C. | $D_{min}$ 35° C. | Srel* 15° C. | Srel* 25° C. | Srel* 35° C. |
|---|---|---|---|---|---|---|---|---|---|---|
| | R | 1.91 | 1.94 | 1.92 | 0.35 | 0.35 | 0.36 | 71 | 100 | 118 |
| | B | 1.75 | 1.73 | 1.71 | 0.24 | 0.26 | 0.28 | 90 | 100 | 108 |
| F | G | 1.80 | 1.82 | 1.85 | 0.23 | 0.24 | 0.28 | 81 | 100 | 117 |
| | R | 1.85 | 1.87 | 1.90 | 0.34 | 0.35 | 0.37 | 77 | 100 | 120 |

*Srel is a relative sensitivity and indicates a reciprocal value of the exposure amount required to obtain the ½ density of the sum of the maximum density and the minimum density.

**B, G and R each represents a blue sensitive layer, a green sensitive layer and a red sensitive layer.

As can clearly be seen from the results shown in the table above, in Light-Sensitive Sheet F using Compound 1 in accordance with the present invention, the reduction in $D_{max}$ is small and, in addition, variations in $D_{max}$ or Srel are reduced with respect to the change in temperature during development in comparison to when the fogging agent of a hydrazine derivative type, i.e., Compound A, is used. Also, Compound 1 has a similar temperature dependency to that of Compound B. Furthermore, in Light-Sensitive Sheet F uniform images free from uneveness is obtained, although some unevenness of the images is observed in Light-Sensitive Sheets D and E.

From the results shown in Examples 1 to 3 above, it is apparent that the compounds according to the present invention are characterized by less temperature dependency and good solubility in solvents.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic light-sensitive material comprising a support having coated thereon a light-sensitive unfogged, internal latent image silver halide photographic emulsion layer and a hydrophilic colloid layer, at least one of said layers containing a compound represented by the formula (I):

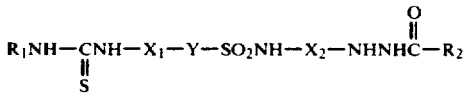

(I)

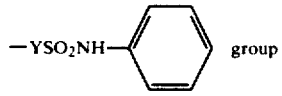

wherein $R_1$ is selected from the group consisting of a straight chain or branched chain substituted or unsubstituted alkyl group, a substituted or unsubstited cycloalkyl group, an alkenyl group, an alkynyl group and a substituted or unsubstituted aryl group; $R_2$ is selected from the group consisting of a hydrogen atom, a straight chain or branched chain substituted or unsubstituted alkyl group, a substituted or unsubstituted cycloalkyl group, an alkenyl group, an alkynyl group, and a substituted or unsubstituted aryl group; $X_1$ and $X_2$, which are the same or different, each is a divalent substituted or unsubstituted aryl group; and Y represents

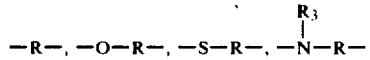

or a direct bond wherein the O or S is bonded to $X_1$, R is selected from the group consisting of a straight chain or branched chain alkylene group or a cycloalkylene group, each of which may contain a double or triple bond, and $R_3$ is selected from the group consisting of a straight or branched chain substituted or unsubstituted alkyl group, a substituted or unsubstituted cycloalkyl group, an alkenyl group, an alkynyl group, and a substituted or unsubstituted aryl group, said compound (I) being present in a fogging amount which gives a suitable maximum density when the light-sensitive material is developed by a surface developing solution.

2. The direct positive silver halide photographic light-sensitive material of claim 1, wherein said light-sensitive unfogged, internal latent image silver halide photographic emulsion layer is associated with a diffusible dye releasing dye image providing material having an o-hydroxyarylsulfamoyl group.

3. The direct positive silver halide photographic light-sensitive material of claim 1, wherein said compound of the formula (I) is present in an amount of about 0.1 mg to 1,000 mg per mol of silver halide.

4. The direct positive silver halide photographic light-sensitive material of claim 1, wherein said compound of the formula (I) is present in an amount of 0.5 mg to 700 mg per mol of silver halide.

5. The direct positive silver halide photographic light-sensitive material of claim 1, wherein said light-sensitive unfogged, internal latent image silver halide photographic emulsion layer is sensitized to red, green or blue light.

6. The direct positive silver halide photographic light-sensitive material of claim 1, wherein said light-sensitive unfogged, internal latent image silver halide photographic emulsion layer contains a sensitizing dye selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes.

7. The direct positive silver halide photographic light-sensitive material of claim 6, wherein the said dye is present in an amount of $1.0\times10^{-5}$ to about $5\times10^{-4}$ mol per mol of silver halide.

8. The direct positive silver halide photographic light-sensitive material of claim 1, wherein $R_1$ and $R_2$ in the formula (I) is an alkyl group, an alkenyl group or an alkynyl group.

9. The direct positive silver halide photographic light-sensitive material of claim 8, wherein the alkyl group for $R_1$ and $R_2$ is an unsubstituted alkyl group or an alkyl group substituted with an alkoxy group, an alkoxycarbonyl group, a carbamoyl group, a hydroxy group, an alkylthio group, an amido group, an acyloxy group, a sulfonyl group, a halogen atom or an aryl group.

10. The direct positive silver halide photographic light-sensitive material of claim 1, wherein $R_1$ and $R_2$ is a phenyl group, a naphthyl group, or a phenyl or naphthyl group substituted with an alkyl group, an alkoxy group, a hydroxy group, a carbamoyl group or a halogen atom.

11. The direct positive silver halide photographic light-sensitive material of claim 1, wherein $X_1$ and $X_2$ is a phenylene group, a naphthylene group or a phenylene group substituted with an alkyl group, an aralkyl group, an alkoxy group, a substituted alkoxy group, a hydroxy group, an amino group, a substituted amino group, an amido group or a halogen atom.

12. The direct positive silver halide photographic light-sensitive material of claim 11, wherein $X_1$ and $X_2$ is a phenylene group.

13. The direct positive silver halide photographic light-sensitive material of claim 12, wherein the $$R_1NHC(=S)NH-$$

is connected to the

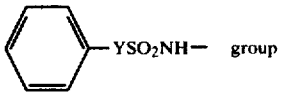

$-YSO_2NH-$ group at the meta or para position and the $$-NHNHC(=O)-R_2 \text{ group}$$

is connected with the T,0573
at the meta or para position thereof.

14. The direct positive silver halide photographic light-sensitive material of claim 1, wherein R is an alkylene group which may contain a double bond or a triple bond.

15. The direct positive silver halide photographic light-sensitive material of claim 1, wherein said compound of the formula (I) is incorporated in said light-sensitive unfogged, internal latent image silver halide photographic emulsion layer.

16. The direct positive silver halide photographic light-sensitive material of claim 1, wherein said light-sensitive unfogged, internal latent image silver halide photographic emulsion layer or adjacent hydrophilic colloid layer contains a diffusible dye-releasing dye image-providing material.

* * * * *